United States Patent [19]

Caramazza

[11] Patent Number: 4,462,597

[45] Date of Patent: Jul. 31, 1984

[54] COMBINED TOMBOLA AND LOTTERY CARD GAME

[76] Inventor: Antonia Caramazza, Via Domenico Silveri, 30, 00165 Rome, Italy

[21] Appl. No.: 391,652

[22] Filed: Jun. 24, 1982

[30] Foreign Application Priority Data

Jun. 8, 1982 [EP] European Pat. Off. ..... 8283016.4

[51] Int. Cl.[3] ..... A63F 1/04

[52] U.S. Cl. ..... 273/296; 273/161; 273/308

[58] Field of Search ..... 273/292, 296, 161, 308

[56] References Cited

U.S. PATENT DOCUMENTS

| | | | |
|---|---|---|---|
| 1,188,204 | 6/1916 | Pitt | 273/296 |
| 2,034,991 | 3/1936 | Salinger | 273/308 |
| 2,154,891 | 4/1939 | Dodge | 273/296 |
| 3,970,315 | 7/1976 | Redner | 273/161 |

FOREIGN PATENT DOCUMENTS

| | | | |
|---|---|---|---|
| Ad.62514 | 1/1955 | France | 273/292 |
| 1577330 | 10/1980 | United Kingdom | 273/292 |

*Primary Examiner*—Anton O. Oechsle

*Attorney, Agent, or Firm*—Beveridge, DeGrandi and Kline

[57] ABSTRACT

Game of combinations of cards numbered 1 to 90 and characterized by images of oneiric or traditional import, derived from the popular Italian games of lottery and tombola combined.

7 Claims, 90 Drawing Figures

COMBINED TOMBOLA AND LOTTERY CARD GAME

Figure 1:
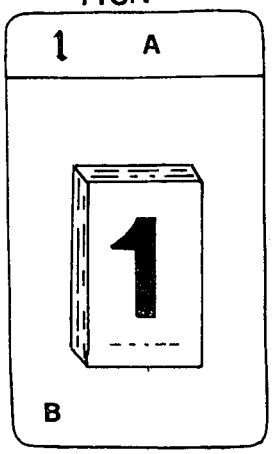
Figure 2:
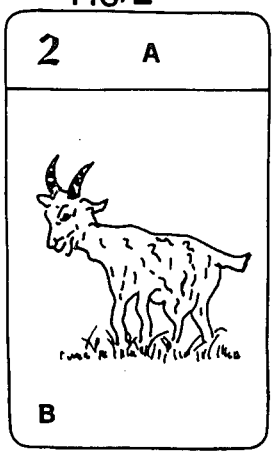
Figure 3:
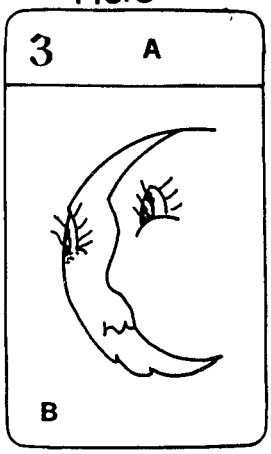
Figure 4:
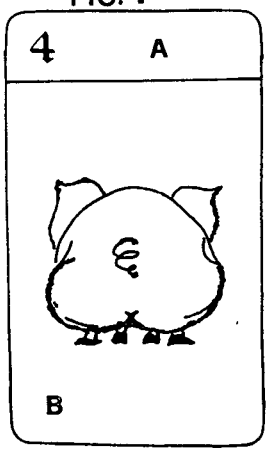
Figure 5:
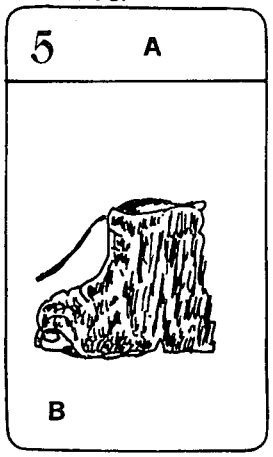
Figure 6:
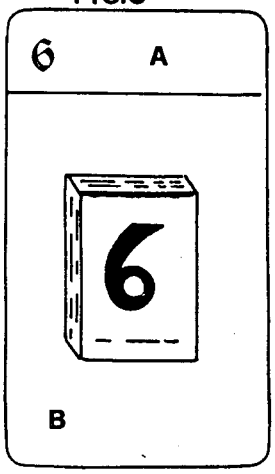
Figure 7:
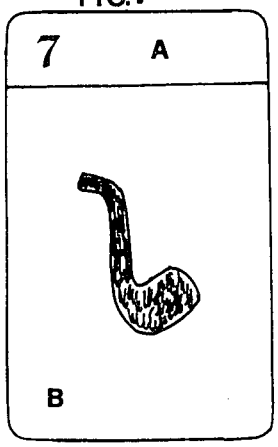
Figure 8:
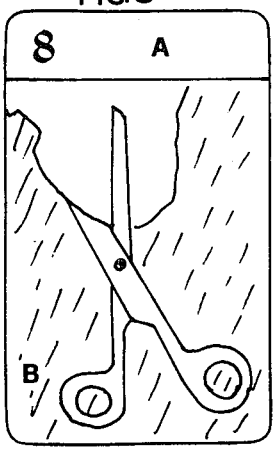
Figure 9:
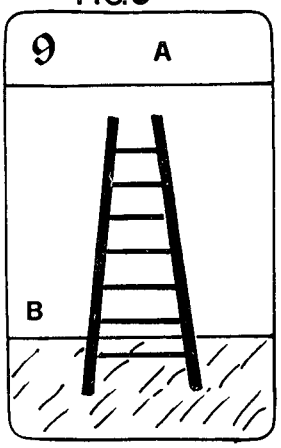
Figure 10:
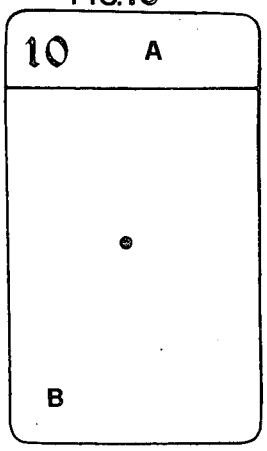
Figure 11:
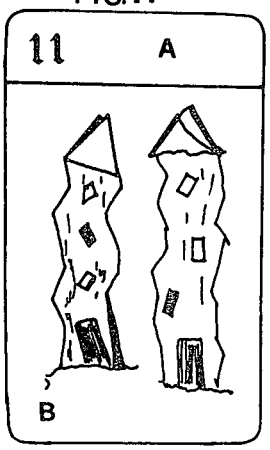
Figure 12:
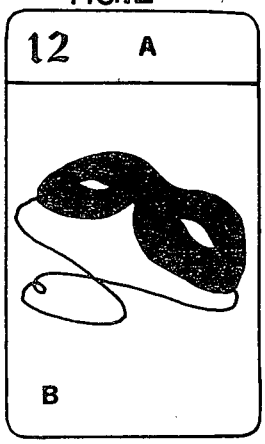
Figure 13:
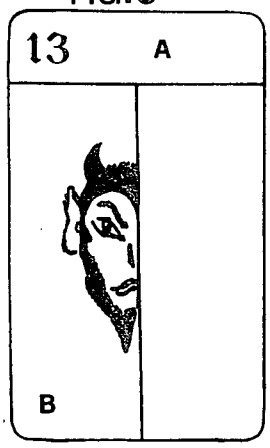
Figure 14:
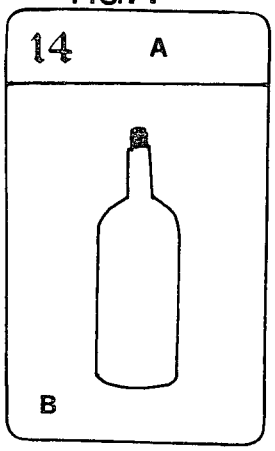
Figure 15:
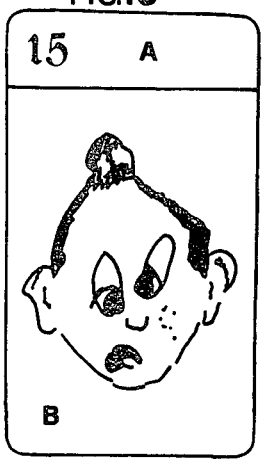
Figure 16:
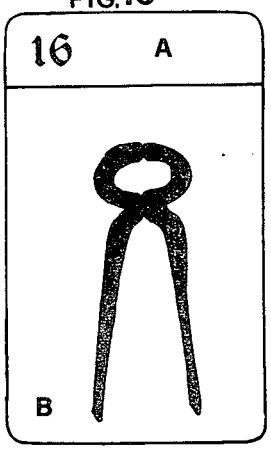
Figure 17:
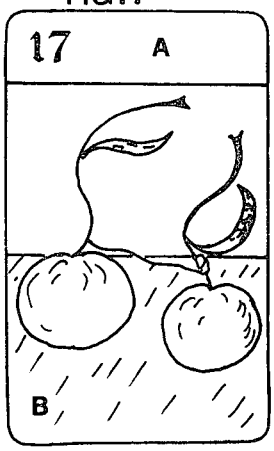
Figure 18:
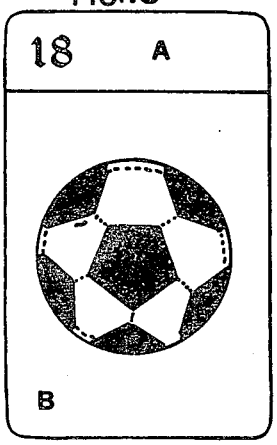
Figure 19:
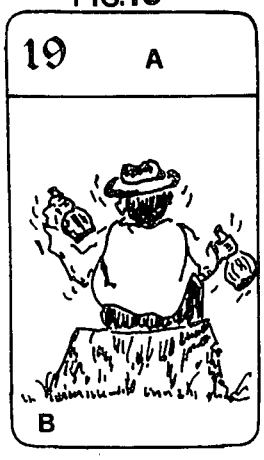
Figure 20:
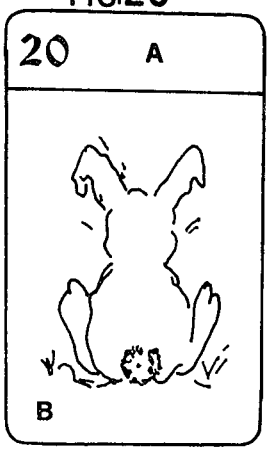
Figure 21:
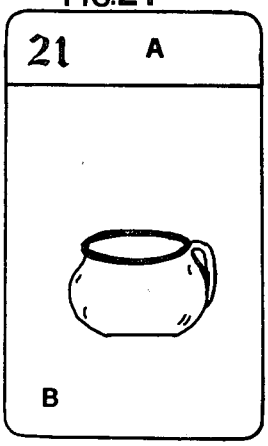
Figure 22:
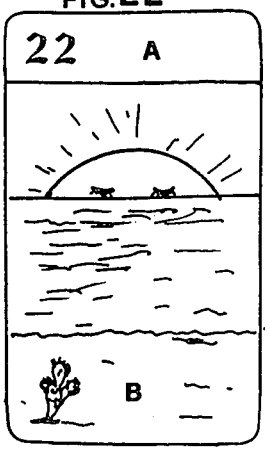
Figure 23:
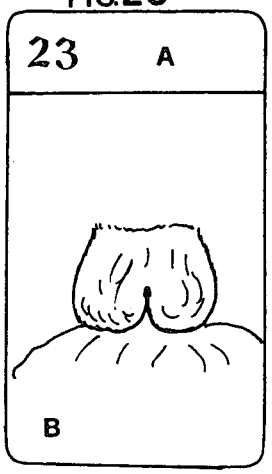
Figure 24:
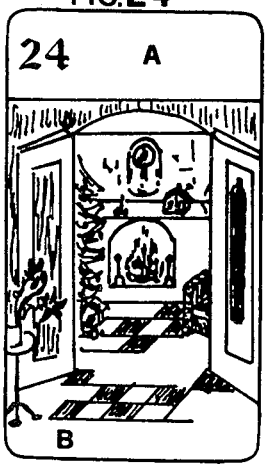
Figure 25:
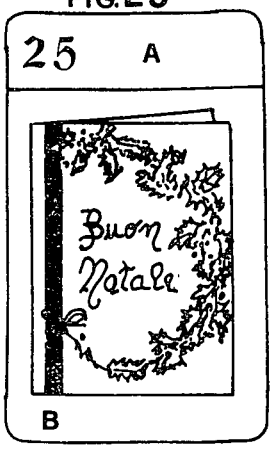
Figure 26:
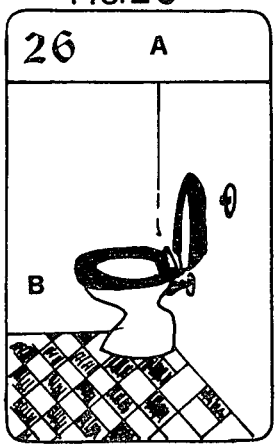
Figure 27:
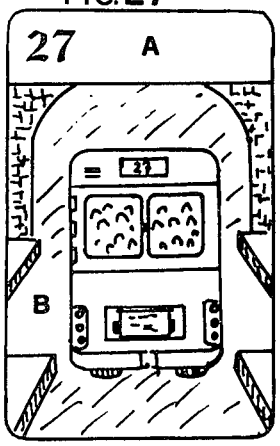
Figure 28:
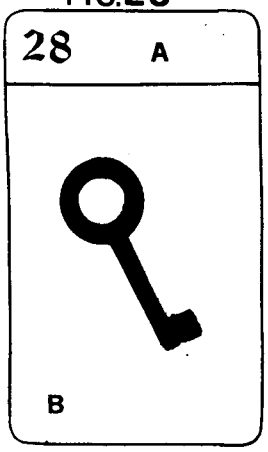
Figure 29:
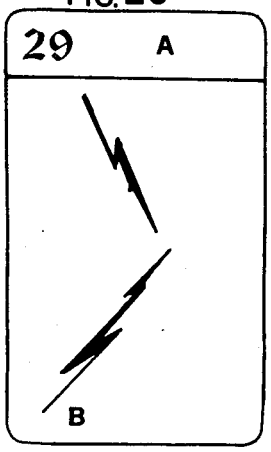
Figure 30:
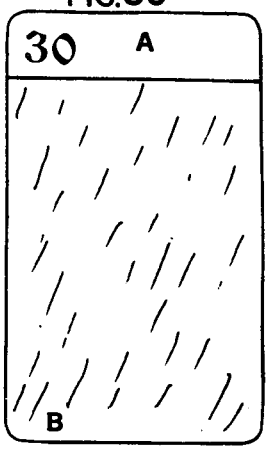
Figure 31:
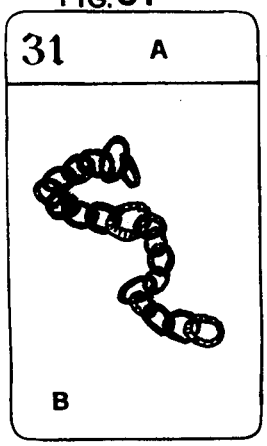
Figure 32:
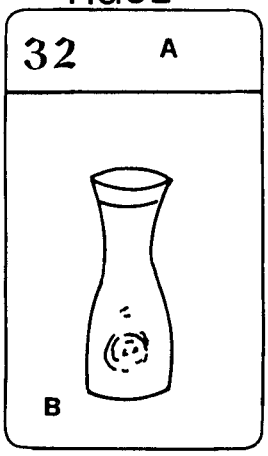
Figure 33:
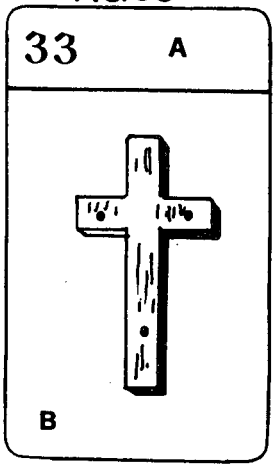
Figure 34:
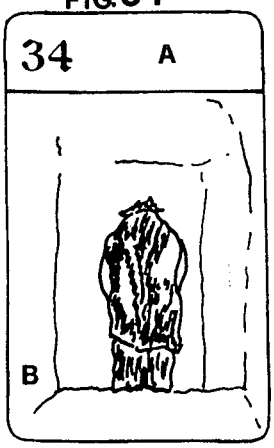
Figure 35:
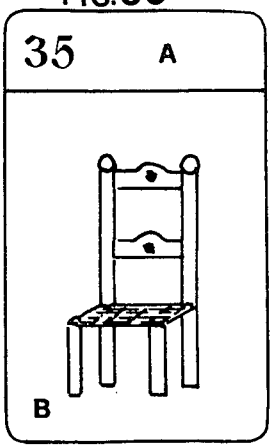
Figure 36:
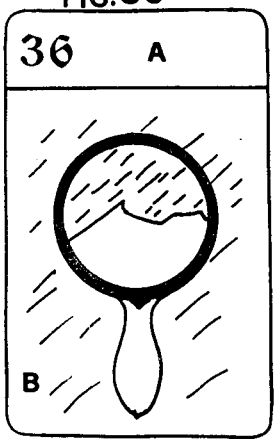
Figure 37:
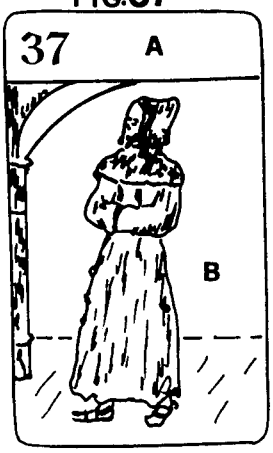
Figure 38:
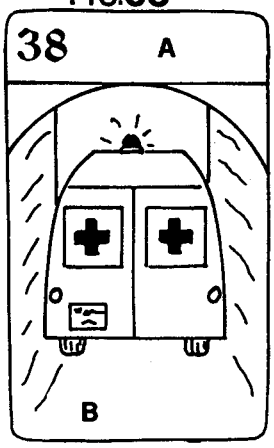
Figure 39:
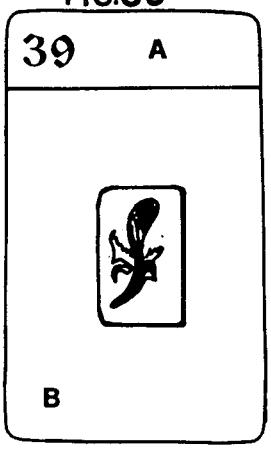
Figure 40:
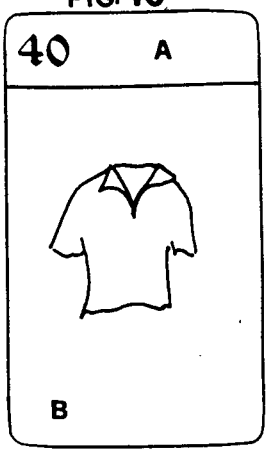
Figure 41:
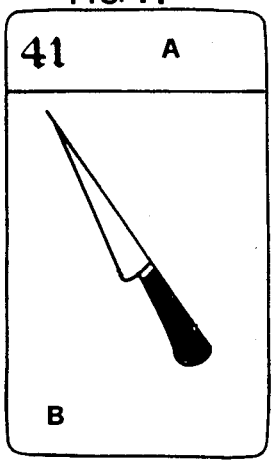
Figure 42:
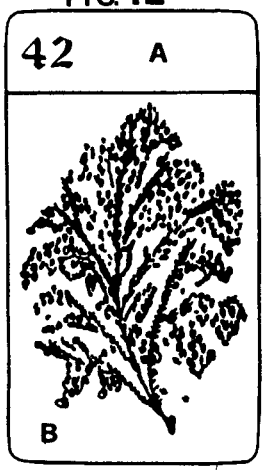
Figure 43:
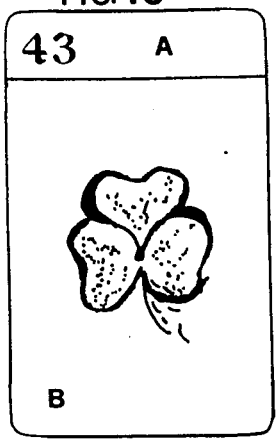
Figure 44:
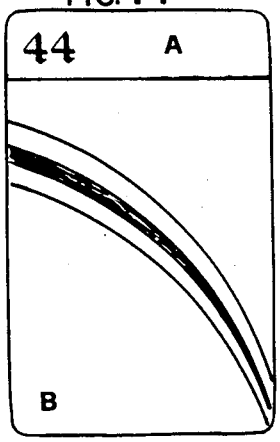
Figure 45:
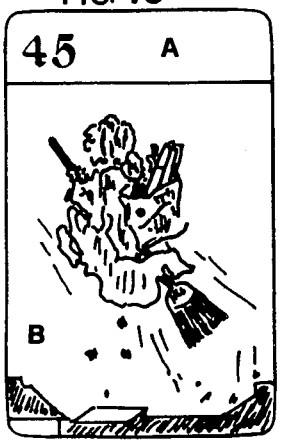
Figure 46:
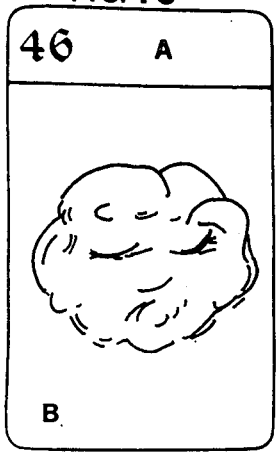
Figure 47:
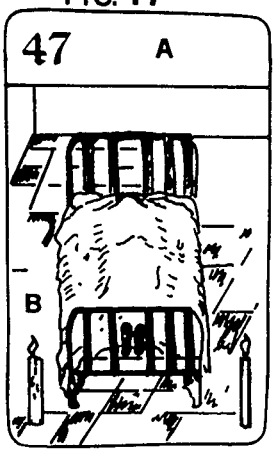
Figure 48:
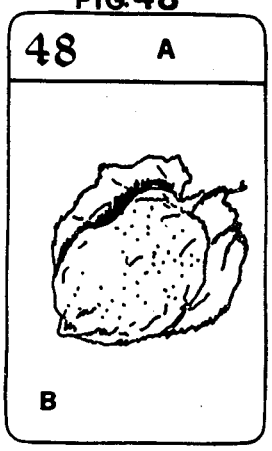
Figure 49:
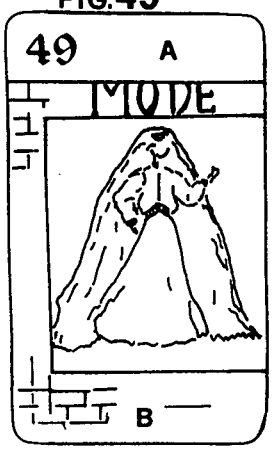
Figure 50:
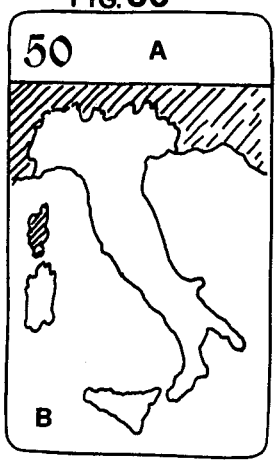
Figure 51:
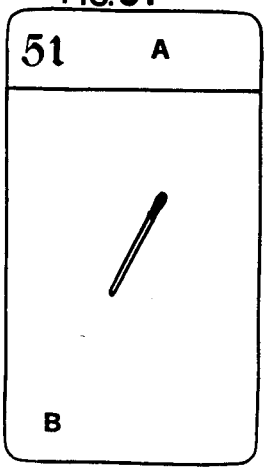
Figure 52:
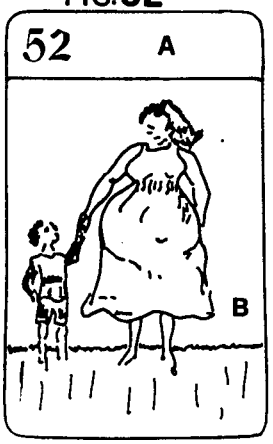
Figure 53:
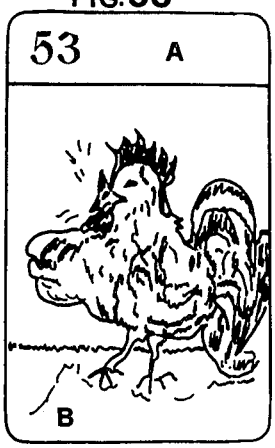
Figure 54:
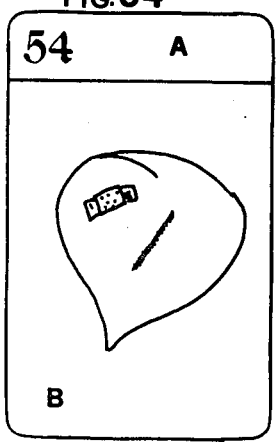
Figure 55:
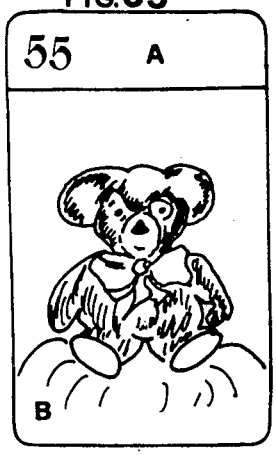
Figure 56:
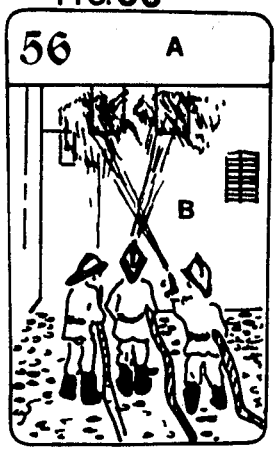
Figure 57:
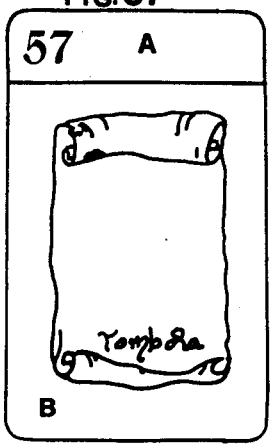
Figure 58:
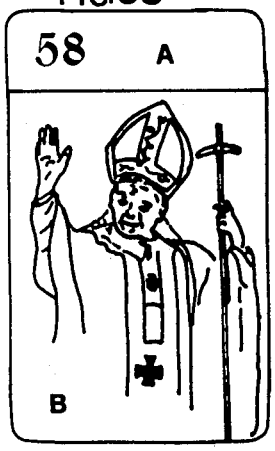
Figure 59:
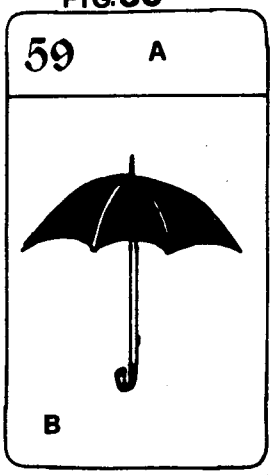
Figure 60:
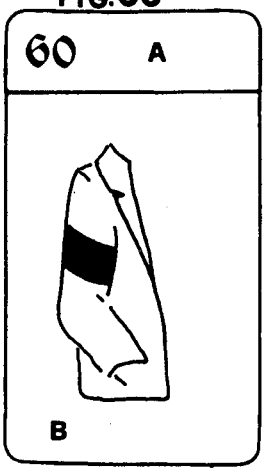
Figure 61:
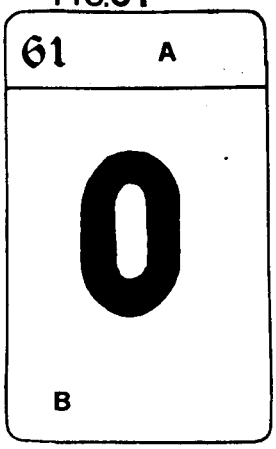
Figure 62:
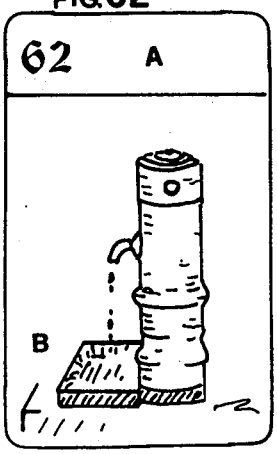
Figure 63:
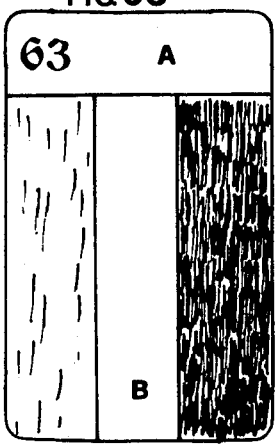
Figure 64:
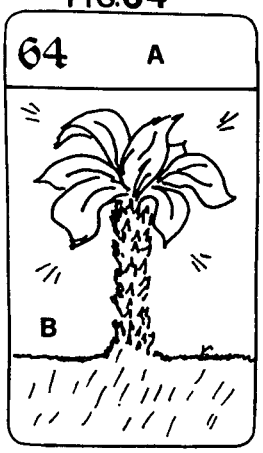
Figure 65:
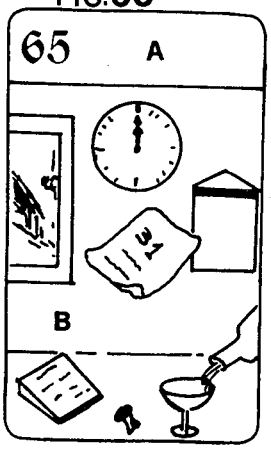
Figure 66:
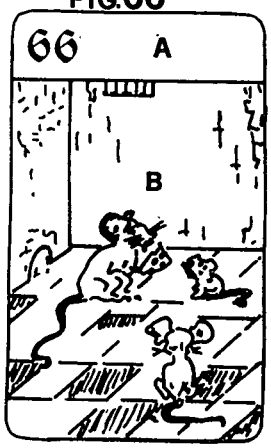
Figure 67:
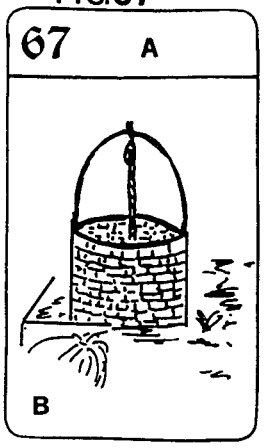
Figure 68:
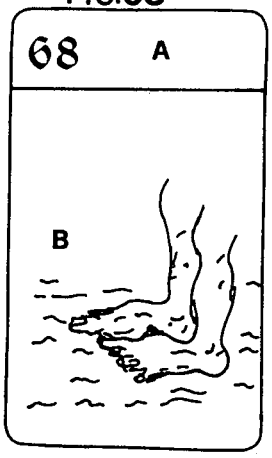
Figure 69:
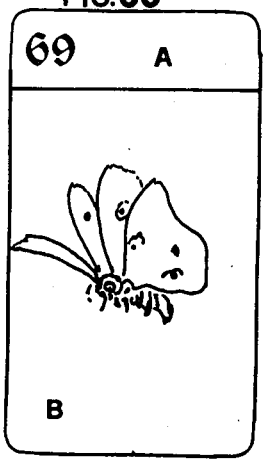
Figure 70:
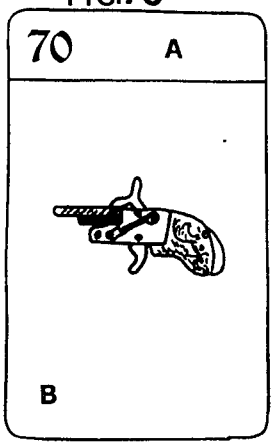
Figure 71:
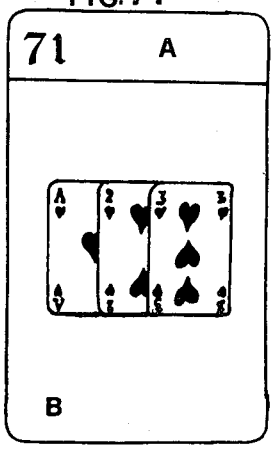
Figure 72:
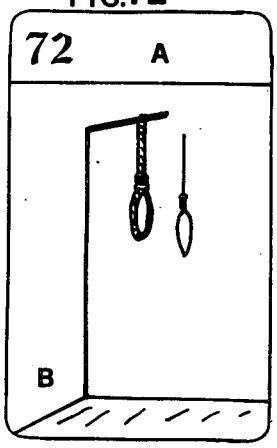
Figure 73:
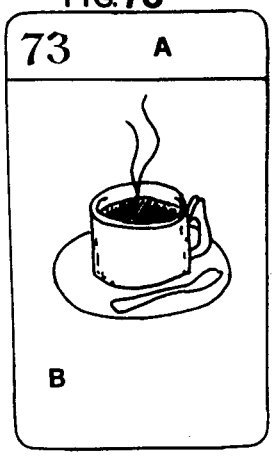
Figure 74:
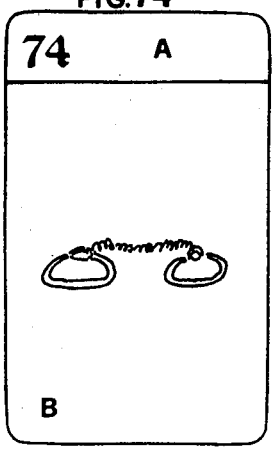
Figure 75:
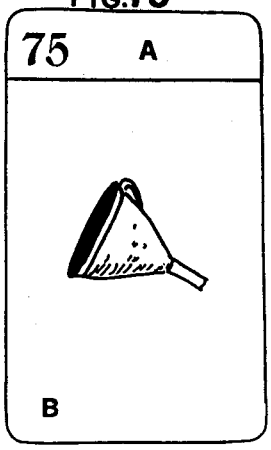
Figure 76:
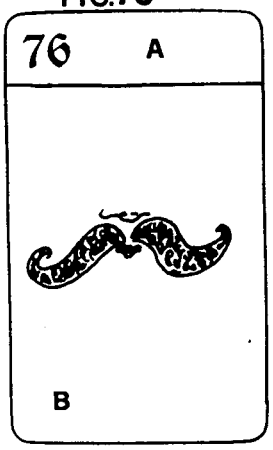
Figure 77:
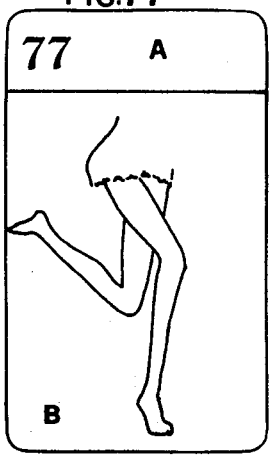
Figure 78:
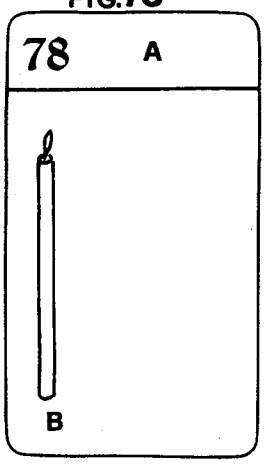
Figure 79:
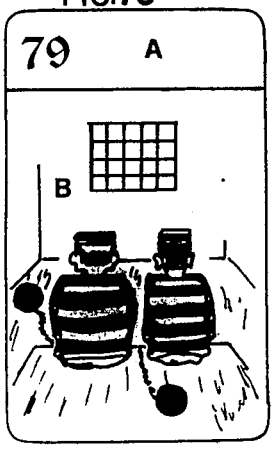
Figure 80:
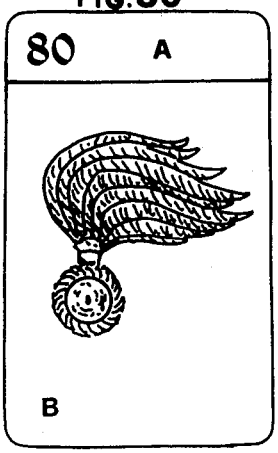
Figure 81:
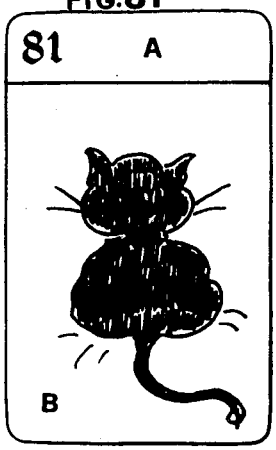
Figure 82:
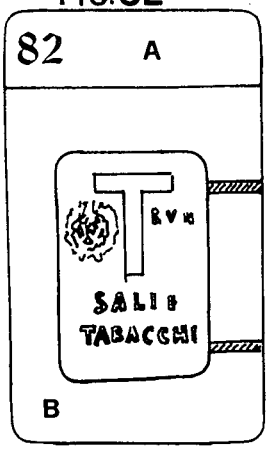
Figure 83:
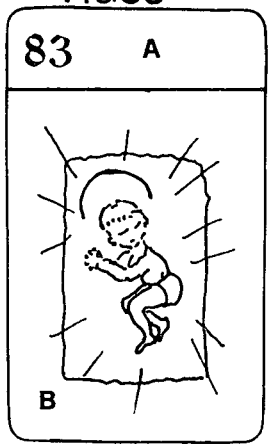
Figure 84:
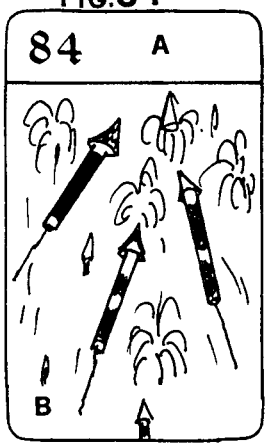
Figure 85:
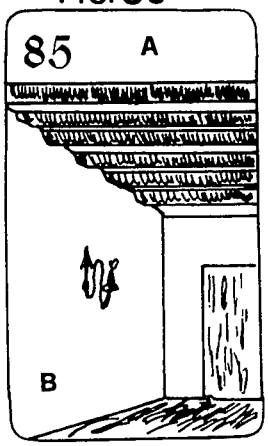
Figure 86:
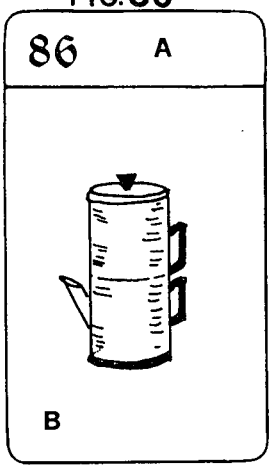
Figure 87:
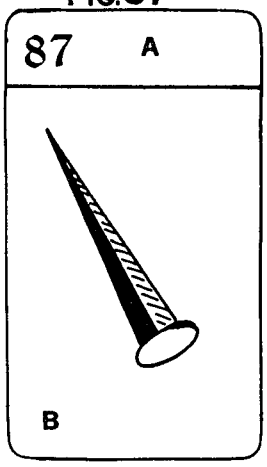
Figure 88:
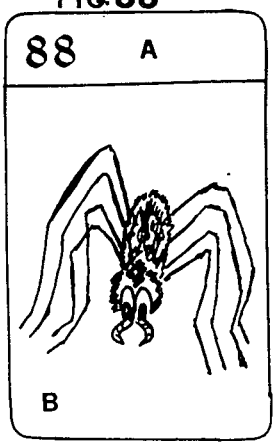
Figure 89:
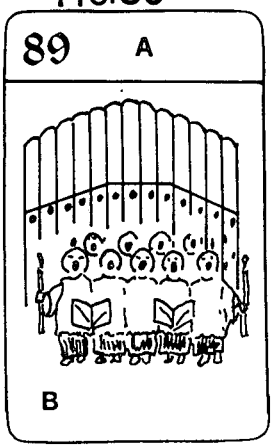
Figure 90:
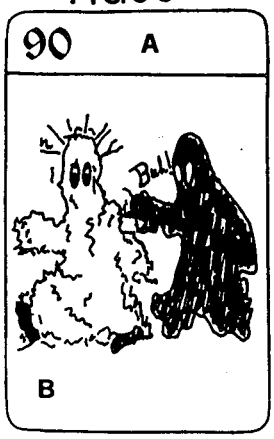

The invention involves new cards designed for playing several games derived from the popular Italian games of lottery and tombola, up to now played with other devices.

The cards according to this invention consist of two packs of 90 cards each: the player's pack has cards with the numbers 1 to 90 on the back and with the same numbers on the front plus either pictures of figures, objects, personalities derived from the so-called 'dream book' of the lottery, which preferably with oneiric images associates different meanings to each number, or some traditional symbols related to the numbers of the tombola game, so as to blend the two games together; the dealer's deck has identical cards except that the back has no numbers.

A complete series of the various cards with different pictures from the 'dream book' are shown in the attached drawings in a purely exemplificative and non-limiting way.

In particular, the drawings show the cards with the number between 1 and 90 on the top followed by the written description A of the meaning shown in the picture on the bottom B, so that they partially overlap in a minimum surface, leaving said numbers clearly visible during the game.

The figures represent the following 90 cards:

| | | | |
|---|---|---|---|
| 1 | New Year | 46 | cloud |
| 2 | goat | 47 | speaking dead |
| 3 | half moon | 48 | lemon |
| 4 | pig | 49 | wedding gown |
| 5 | broken shoe | 50 | Italy |
| 6 | Epiphany | 51 | match |
| 7 | pipe | 52 | mama |
| 8 | scissors | 53 | singing rooster |
| 9 | ladder | 54 | broken heart |
| 10 | mole | 55 | bear |
| 11 | earthquake | 56 | firemen |
| 12 | carneval | 57 | will |
| 13 | devil | 58 | pope |
| 14 | bottle | 59 | umbrella |
| 15 | bump | 60 | mourning |
| 16 | tongs | 61 | zero |
| 17 | bad luck | 62 | fountain |
| 18 | ball | 63 | tricolor |
| 19 | drunk | 64 | blessed palm |
| 20 | rabbit | 65 | year's end |
| 21 | chamber pot | 66 | mice |
| 22 | sunset | 67 | well |
| 23 | buttocks | 68 | foot bath |
| 24 | Christmas Eve | 69 | butterfly |
| 25 | Christmas | 70 | pistol |
| 26 | toilet | 71 | playing cards |
| 27 | bus | 72 | gallows |
| 28 | key | 73 | cup of coffee |
| 29 | thunderbolt | 74 | handcuffs |
| 30 | pitch black | 75 | funnel |
| 31 | chain | 76 | moustache |
| 32 | flask | 77 | female legs |
| 33 | Christ's age | 78 | candlelight |
| 34 | hunchback | 79 | prisoners |
| 35 | chair | 80 | police |
| 36 | broken mirror | 81 | black cat |
| 37 | monk | 82 | tobacconist |
| 38 | ambulance | 83 | baby Jesus |
| 39 | ace | 84 | fireworks |
| 40 | shirt | 85 | ceiling |
| 41 | knife | 86 | coffee pot |
| 42 | mimosa | 87 | nail |
| 43 | clover | 88 | spider |
| 44 | rainbow | 89 | sung mass |
| 45 | witch | 90 | fear. |

Naturally, as a variation, the deck of cards may have different pictures related to the meanings attributed to numbers in different countries, keeping the numbers from 1 to 90 for the purposes of the game.

One possible card game according to this invention may be described as follows: the dealer, who is also the banker, deals the cards with the numbered backs to the players as a function of the number of players, after all the players have made a preliminary bet in money, chips, or the like and the dealer has divided the prize money which, in analogy with the game of tombola and depending on the number of players, may correspond to sets of 2, 3, 4 and 5 winning numbers and/or to the top winner, the players turn their cards over on the table; after shuffling them, the dealer begins to turn over the cards in his deck, with no numbers on the back, while enlivening the game with his own asides, and arranges them in various columns, one under the other so that the numbers and descriptions on the top of each card are visible to provide a check on the numbers already played; in this way, as the cards are played, each player turns over his cards corresponding to the numbers already played, leading in succession to the sets of 2, 3, 4, 5 and top winners, as in tombola, that is to the covering of all his cards.

In another variation the cards according to this invention may be used for one phase of a real game of chance consisting of the selection of one card only per player, betting and eventual winning as said card is played among 50 of the 90 possible cards taken by the banker from his own deck, in analogy with the possibility of 5 numbers for each of the 10 wheels of the lottery in Italy.

Of course, the figures on the cards may be widely varied within the context of representing the symbols of the 'dream book' and the tombola corresponding to each number; also, the game may be played in very many different ways depending only on the players' imagination, particularly if they are expert lottery players.

I claim:

1. A combined tombola and lottery card game comprising a player's deck of 90 cards and a dealer's deck of 90 cards, said cards in both decks being numbered sequentially on the fronts thereof with the numbers 1 to 90, all of said cards in each deck being provided on the fronts thereof with different graphical representations, said graphical representations of the two decks being similar and, in both decks, being associated with cards bearing the same number, said cards in the player's deck being provided on the backs thereof with the same numbers which appear on the front thereof, said cards in the dealer's deck having no numbers on the backs thereof which correspond to the numbers on the front thereof.

2. A combined tombola and lottery card game according to claim 1 wherein said numbers are located on the top, the graphical representations on the bottom, said numbers being followed by a written description of the meaning shown in the graphical representation on the bottom so that they partially overlap in a minimum surface, leaving said numbers clearly visible during the game.

3. A combined tombola and lottery card game according to claim 1 wherein said graphical representations include pictures of figures, objects and personalities.

4. A combined tombola and lottery card game according to claim 3 wherein the figures, objects and personalities are those of the "dream book" of the lottery.

5. A combined tombola and lottery card game according to claim 3 wherein the graphical representations include traditional symbols related to the numbers of the tombola game.

6. A combined tombola and lottery card game according to claim 5 wherein the figures, objects and personalities are those of the "dream book" of the lottery.

7. Combined tombola and lottery card game as claimed in any one of claims 1–6, characterized by the following numbers and meanings of the cards:

| | | | |
|---|---|---|---|
| 1 | New Year | 46 | bloud |
| 2 | goat | 47 | speaking dead |
| 3 | half moon | 48 | lemon |
| 4 | pig | 49 | wedding gown |
| 5 | broken shoe | 50 | Italy |
| 6 | Epiphany | 51 | match |
| 7 | pipe | 52 | mama |
| 8 | scissors | 53 | singing rooster |
| 9 | ladder | 54 | broken heart |
| 10 | mole | 55 | bear |

-continued

| | | | |
|---|---|---|---|
| 11 | earthquake | 56 | firemen |
| 12 | carneval | 57 | will |
| 13 | devil | 58 | pope |
| 14 | bottle | 59 | umbrella |
| 15 | bump | 60 | mourning |
| 16 | tongs | 61 | zero |
| 17 | bad luch | 62 | fountain |
| 18 | ball | 63 | tricolor |
| 19 | drunk | 64 | blessed palm |
| 20 | rabbit | 65 | year's end |
| 21 | chamber pot | 66 | mice |
| 22 | sunset | 67 | well |
| 23 | buttocks | 68 | foot bath |
| 24 | Christmas Eve | 69 | butterfly |
| 25 | Christmas | 70 | pistol |
| 26 | toilet | 71 | playing cards |
| 27 | bus | 72 | gallows |
| 28 | key | 73 | cup of coffee |
| 29 | thunderbolt | 74 | handcuffs |
| 30 | pitch black | 75 | funnel |
| 31 | chain | 76 | moustache |
| 32 | flask | 77 | female legs |
| 33 | Christ's age | 78 | candlelight |
| 34 | hunchback | 79 | prisoners |
| 35 | chair | 80 | police |
| 36 | broken mirror | 81 | black cat |
| 37 | monk | 82 | tobacconist |
| 38 | ambulance | 83 | baby Jesus |
| 39 | ace | 84 | fireworks |
| 40 | shirt | 85 | ceiling |
| 41 | knife | 86 | coffee pot |
| 42 | mimosa | 87 | nail |
| 43 | clover | 88 | spider |
| 44 | rainbow | 89 | sung mass |
| 45 | witch | 90 | fear. |

* * * * *